United States Patent [19]

Leftault, Jr. et al.

[11] Patent Number: 5,058,408

[45] Date of Patent: Oct. 22, 1991

[54] METHOD FOR PARTIALLY ANNEALING THE SIDEWALL OF A CONTAINER

[75] Inventors: Charles J. Leftault, Jr., Murrysville; Ronald W. Gunkel, Lower Burrell; Robert A. Cargnel, Export; E. Scott Douds, Plum Borough, all of Pa.

[73] Assignee: Aluminum Company of America, Pittsburgh, Pa.

[21] Appl. No.: 677,610

[22] Filed: Mar. 27, 1991

Related U.S. Application Data

[63] Continuation of Ser. No. 472,025, Jan. 30, 1990, abandoned.

[51] Int. Cl.[5] ..... B21D 26/14

[52] U.S. Cl. ..... 72/56; 72/342.1

[58] Field of Search ..... 72/56, 342.1, 364, 707

[56] References Cited

U.S. PATENT DOCUMENTS

| | | | |
|---|---|---|---|
| 2,309,181 | 1/1943 | Franck | 72/342 |
| 3,088,200 | 5/1963 | Birdsall et al. | 72/56 |
| 3,447,350 | 6/1969 | Schenk | 72/56 |
| 3,845,667 | 11/1974 | Honrath et al. | 72/56 |
| 4,007,616 | 2/1977 | Aleck | 72/342 |
| 4,170,887 | 10/1979 | Baranov | 72/56 |
| 4,220,106 | 9/1980 | Supik | 219/10.43 |
| 4,372,719 | 2/1983 | Supik | 72/342 |
| 4,441,354 | 4/1984 | Bodega | 72/342 |

*Primary Examiner*—Lowell A. Larson
*Attorney, Agent, or Firm*—William J. O'Rourke

[57] ABSTRACT

This invention provides a method of bulging at least a portion of a sidewall of a drawn or drawn and ironed aluminum container body. The method involves an initial thermal treatment step prior to bulging. The thermal treatment is provided to that portion of the sidewall of the container that is to be bulged and is sufficient to reduce the yield strength of that portion of the sidewall about 20% without substantially adversely affecting the yield strength of the bottom wall of the container. After thermal treatment, at least a portion of the thermally treated sidewall is bulged at a circumferential strain greater than about 5% to provide container shape.

12 Claims, 2 Drawing Sheets

BEST AVAILABLE COPY

METHOD FOR PARTIALLY ANNEALING THE SIDEWALL OF A CONTAINER

This application is a continuation of application Ser. No. 07/472,025 filed Jan. 30, 1990, now abandoned.

BACKGROUND OF THE INVENTION

1. Field of the Invention

This invention pertains to a method for partially annealing the sidewall of a container, and more particularly to a method of thermally treating portions of a sidewall of a drawn or drawn and ironed container body to render the container sidewall capable of being bulged successfully.

2. Description of the Art

Various methods are known in the art for shaping articles, such as drawn metallic containers. U.S. Pat. No. 1,711,445, for example, discloses a method in which a plunger and compressed air cooperate to bulge container sidewalls against the face of an adjacent die. U.S. Pat. No. 2,787,973 pertains to a method for hydraulically expanding a container into tight contact with a surrounding mold. High voltage discharge forming of containers against a fixed mold is described, for example, in U.S. Pat. No. 3,654,788. Also, electromagnetic forming, disclosed in U.S. Pat. Nos. 3,383,890 and 3,599,461, involves the generation of a pulse of electromagnetic force against the sidewalls of an adjacent container to reform the container.

Additionally, the prior art teaches the use of induction heating for the purpose of annealing tubular articles prior to subsequent forming operations. For example, U.S. Pat. No. 3,413,432 discloses the induction heating of a metal tube prior to circumferentially enlarging the tube ends. U.S. Pat. No. 4,307,276 pertains to a method of uniformly heating long steel pipes by passing the pipes through one or more induction heating coils to heat treat the pipe.

Despite the prior art teachings in the area of container shaping, and in the area of annealing, there is no teaching of preferred methods of thermally treating selective areas of a container sidewall prior to shaping. In particular, there is a need for a method for partially annealing selective areas of the sidewall of a container to selectively reduce the yield strength and increase formability in such areas to permit successful subsequent bulging of such thermally treated areas.

SUMMARY OF THE INVENTION

This invention may be summarized as providing a method of bulging at least a portion of a sidewall of a drawn, or drawn and ironed, aluminum container body. This method involves an initial thermal treatment step prior to bulging. The thermal treatment is selectively provided to that portion of the sidewall of the container that is to be bulged and is sufficient to reduce the yield strength of that portion of the sidewall by at least about 20% without substantially adversely affecting the yield strength of the bottom wall of the container. After thermal treatment, at least a portion of the thermally treated sidewall is bulged at a circumferential strain greater than about 5% to reshape the container and thereby provide container shape and increase the yield strength of the bulged portions of the sidewall.

Among the advantages of this invention is the provision of a method for thermally treating selected portions of the sidewalls of a drawn aluminum container to insure success in the subsequent bulging of such thermally treated portions.

Another advantage of this invention is that selective thermal treatment of the sidewalls of a container body insures that untreated areas retain their yield strength.

An objective of this invention is to develop a method of annealing that provides the capability of bulging thermally treated container sidewalls in a viable high production rate manufacturing process.

A feature of this invention is the provision of a method which insures that selected areas of a container sidewall are adequately thermally treated such that subsequent bulging of such selected areas to produce a container having a differentiated shape is repeatedly successful.

Another advantage of the method of this invention is to provide a method of rapidly achieving a partial anneal of the selected area of a sidewall of a container to be subsequently bulged through the use of a preferred localized induction heating process.

These and other objectives and advantages of the invention will be more thoroughly understood and appreciated with reference to the following description and the accompanying drawings.

DETAILED DESCRIPTION

The present invention is directed to a method for selectively heat treating circumferential portions of a drawn, or drawn and ironed, aluminum container to reduce the yield strength and to increase the formability of the circumferential portion. Throughout this application, the term drawn is intended to include drawn as well as drawn and ironed. The mechanical property modifications achieved by the heat treatment process permits the circumferential portion to be bulged successfully, as is explained in detail below. The drawn containers of this invention include food cans, beer and beverage cans and other aluminum rigid packages of various diameter and height having a generally cylindrical configuration.

The present invention is particularly directed to aluminum sheet and drawn aluminum containers. The term aluminum is intended to encompass aluminum and aluminum alloys in coated and uncoated condition, including, but not limited to, metal dominant polymer aluminum laminates. Such coatings include protective and decorative coatings which may be applied on the inside or outside surfaces of the container before or after drawing or bulging of the metal.

Figure 1:
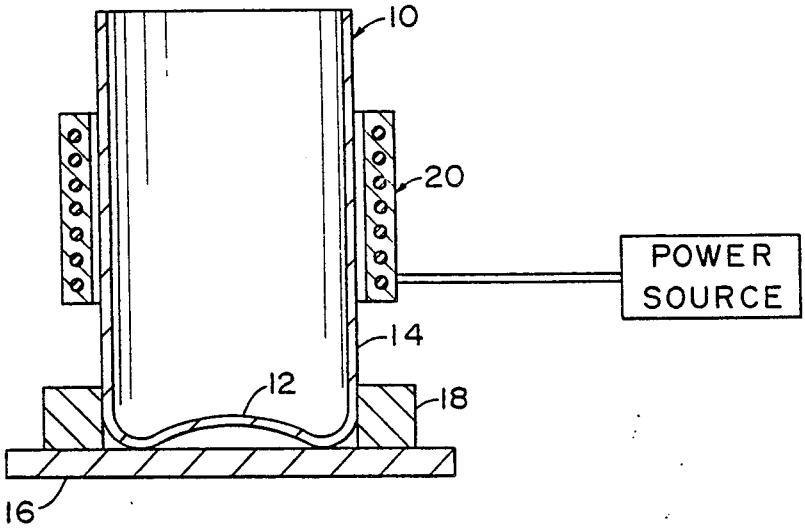
FIG. 1 is a cross sectional view of an induction heating coil around a circumferential portion of a container body.

Referring particularly to the drawings, FIG. 1 shows a drawn container 10 having a generally cup-shaped body. The container 10 includes a bottom end wall 12 and generally cylindrical sidewalls 14. Sidewalls of such containers are typically from about 0.002 to about 0.030 inch thick, and have diameters on the order of about 2 to 3 inches. A function of the typical drawing process is the formation of such a container 10 with the sidewalls disposed in a right cylinder, i.e., the sidewalls being perpendicular to the general plane of the bottom end wall 12.

In the formation of a drawn, aluminum food can, such as a 5042 aluminum alloy, H-19 temper, 300×407 aluminum food can, the metal is drawn and redrawn in multiple stages after the sheet has been annealed. In a three draw operation, the first draw typically achieves a 39% reduction, while a 25% reduction is achieved in the second draw, and a 22% reduction is achieved in the third draw. Such drawing and redrawing operations cause hardening and texture evolution in the sidewall. Yield stresses for the sidewall of the drawn container are higher than the yield stresses for the annealed 5042-H19 starting sheet from which the container is formed. After drawing, the sidewalls typically exhibit a yield strength in excess of about 30 ksi.

Material tensile yield strength levels increase significantly in can sidewalls during drawing and redrawing. The work hardening and associated ductility losses prevent successful bulging of such sidewalls at circumferential strain rates that are significant, such as circumferential strain rates on the order of from about 5% to about 20%. Similar mechanical property changes occur during formation of drawn and ironed aluminum beverage cans, such as 3004 aluminum alloy, H-19 temper cans.

A thermal treatment of the sidewalls of drawn containers is necessary to allow successful bulging of the container sidewalls. Otherwise, the bulging operation could exceed the formability capability of the metal and cause catastrophic failure. Such thermal treatment is conducted for a sufficient time and at a sufficient temperature to lower the yield strength of the sidewalls by at least 15% to permit subsequent bulging. For example, by partially annealing the sidewall of an original 5042 alloy, 0 temper, 208×207 food can, at a temperature of about 450° F. for about one hour, the yield strength of the sidewall falls to about 29 ksi, and elongation increases to about 10%. Achieving such properties through a partial anneal process permits successful bulging of the container at circumferential strain rates on the order of 13%.

The thermal treatment of the present invention may be accomplished by a variety of methods. As illustrated in FIG. 1, a container body 10 to be heat treated may be placed on a base 16. A positioning ring 18 on the base 16 may be utilized to properly position the container 10. In a preferred embodiment the base 16 may be provided with a projection which mates with a contour of the bottom end wall of the container 10 to further insure proper positioning.

Once positioned, selected circumferential portions of the sidewall of the container 10 are preferably heated with a conventional induction heating coil 20, consisting of heating elements in an appropriate housing as shown in the drawing. It should be noted that preferential heating may be achieved with a coil disposed inside an aluminum container. A power supply capable of supplying about 2.5 to 5.0 kilowatts has been found adequate to locally induction heat, and thereby partially anneal the selected circumferential portions of the sidewall 14 of a container body. By exposing the sidewall to an induction heating temperature of about 450°–650° F. for a time of from about 0.25 to about 10 seconds, and preferably at a temperature of from 550° F. to 650° F. for 0.25 to 10 seconds, accomplishes the required partial anneal of the adjacent circumferential portions. In a preferred embodiment the coil-to-can distance is from about ⅛ inch to about ¼ inch. Coil-to-can distances of 0.025 inch have been experienced successfully.

Figure 2:
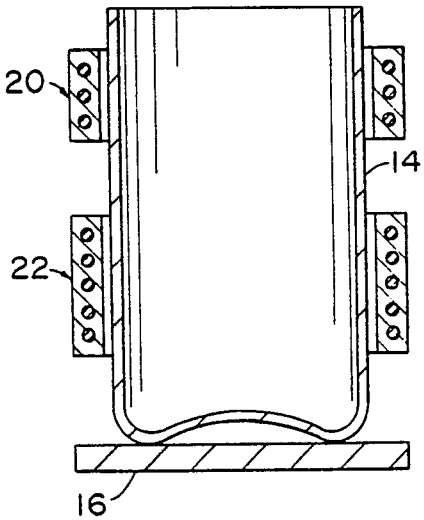
FIG. 2 is a cross sectional view of a pair of induction heating coils around spaced apart circumferential portions of a container body.

An alternative induction heating apparatus including a first coil 20 and a second coil 22 is illustrated in FIG. 2. Such alternative apparatus could be utilized, surrounding and/or disposed inside the container body, to selectively, locally anneal multiple circumferential portions of a container sidewall for subsequent bulging of the multiple circumferential portions. It will be appreciated by those skilled in the art that any number of coils may be utilized to locally, partially anneal a number of selected portions of a container body.

An alternative heat treatment process involves the use of heat sinks, not shown, within an annealing furnace environment. Exposing the circumferential portions of the sidewall to a temperature of about 450° F. for from 2–3 minutes to about one hour accomplishes the desired partial anneal thereof.

It is desired in the partial anneal or heat treatment of this invention that the yield strength of the can sidewalls be reduced by at least 15% in the selected circumferential portions. It is equally important to avoid reducing the yield strength or otherwise adversely affecting the properties of the remaining portions of the container body. Therefore, the partial anneal is limited to those circumferential portions of a container sidewall which are intended to be subsequently reformed or bulged.

If an entire container body is annealed, such as by feeding the entire container through an annealing oven, problems may arise. For example, the mechanical properties of the entire container may be reduced. The time required to accomplish the anneal through an annealing oven is also excessive. In such an anneal process, batch type processing may be required, which process typically makes control more difficult, and, additionally, columnar strength, bottom dome reversal strength and pressure resistance of a container annealed in this fashion may be unacceptable.

The present invention is directed to a method which focuses heat treatment only on those circumferential portions of the container sidewall which are intended to be subsequently bulged. Therefore, the strength characteristics of the remaining portions of the container are not adversely affected. Additionally, although the yield strength of the heat treated portions is lowered in the partial anneal process, the subsequent bulging has the cold working effect of increasing the yield strength of the reformed or bulged metal. This increase in yield strength does not typically raise the yield strength of the bulged metal to the level of yield strength which resulted from the drawing or the drawing and ironing process, but it is increased.

The following Table 1 illustrates tensile properties of various specimens of sheet and cans made from the sheet. The can specimens were taken circumferentially about a drawn container body. All sheet and can specimens were 5042 aluminum alloy and 0 temper

TABLE 1

| Specimen No. | Form | Condition | (ksi) Yield Strength | (ksi) Ultimate Tensile Strength | (%) Elongation |
|---|---|---|---|---|---|
| 1 | sheet | annealed sheet | 16.0 | 34.8 | 18.0 |
| 2 | sheet | annealed sheet | 16.1 | 33.1 | 26.0 |
| 3 | sheet | annealed sheet | 16.4 | 33.6 | 25.0 |
| 4 | can body | drawn | 36.2 | 43.8 | 6.0 |
| 5 | can body | drawn | 36.4 | 43.2 | 6.0 |
| 6 | can body | drawn | 34.8 | 41.4 | 6.0 |
| 7 | can body | drawn & redrawn | 39.6 | 46.8 | 6.0 |
| 8 | can body | drawn & redrawn | 36.8 | 43.6 | 4.0 |
| 9 | can body | drawn & redrawn | 33.5 | 40.4 | 5.0 |
| 10 | can body | drawn, redrawn & annealed | 28.2 | 38.5 | 11.0 |
| 11 | can body | drawn, redrawn & annealed | 26.6 | 37.6 | 10.0 |
| 12 | can body | drawn, redrawn & annealed | 25.5 | 36.7 | 11.0 |

All can specimens in can body form were taken along a location in the circumferential direction in the can sidewall, oriented at a 0° angle to the rolling direction. The partial anneal treatment was a one hour treatment at a temperature of 450° F.

The following Table 2 illustrates tensile properties of specimens of 5042 aluminum alloy in the H-19 temper.

TABLE 2

| Specimen No. | Form | Condition | (ksi) Yield Strength | (ksi) Ultimate Tensile Strength | (%) Elongation |
|---|---|---|---|---|---|
| 1 | sheet | H-19 temper | 47.1 | 51.9 | 5.5 |
| 2 | sheet | H-19 temper + anneal | 33.7 | 42.2 | 10.5 |
| 3 | can body | drawn & redrawn | 42.8 | 48.8 | 5.0 |
| 4 | can body | drawn, redrawn & annealed | 31.5 | 39.0 | 11.0 |

All specimens were 5042 aluminum alloy sheet in H-19 temper. Can body specimens were taken along a location in the circumferential direction in the can sidewall, oriented at a 0° angle to the rolling direction. The partial anneal treatment was a one hour treatment at a temperature of 450° F.

Table 3 shows the tensile strength properties, including elongation, of specimens of two 2.75 inch tall cans, can A and can B, drawn and redrawn from aluminum alloy 5042-H19 temper. The circumferential specimens were taken along top, middle and bottom portions of the cans after a central location of the can was partially annealed by induction heating at a temperature of about 600° F. for about 5 seconds. The top specimen was centered at about 0.75 inch from the top wall; the middle specimen was centered at about 1.00 inch from the top wall; and the bottom specimen was centered at about 1.25 inch from the top wall.

TABLE 3

| Specimen No. | Can No. | Location | Orientation | (ksi) Yield Strength | (ksi) Ultimate Tensile Strength | (%) Elongation |
|---|---|---|---|---|---|---|
| 1 | A | top | 0° | 41.0 | 47.9 | 6.0 |
| 2 | A | top | 0° | 39.5 | 47.4 | 6.0 |
| 3 | A | middle | 90° | 20.0 | 36.1 | 24.0 |
| 4 | A | middle | 90° | 28.4 | 38.7 | 18.0 |
| 5 | A | bottom | 0° | 39.1 | 47.0 | 7.0 |
| 6 | A | bottom | 0° | 37.3 | 46.2 | 7.0 |
| 7 | B | top | 0° | 39.7 | 46.4 | 5.0 |
| 8 | B | top | 0° | 40.1 | 47.1 | 5.0 |

TABLE 3-continued

| Specimen No. | Can No. | Location | Orientation | (ksi) Yield Strength | (ksi) Ultimate Tensile Strength | (%) Elongation |
|---|---|---|---|---|---|---|
| 9 | B | middle | 90° | 18.7 | 35.3 | 24.0 |
| 10 | B | middle | 90° | 23.9 | 36.3 | 20.0 |
| 11 | B | bottom | 0° | 40.0 | 47.0 | 6.0 |
| 12 | B | bottom | 0° | 40.4 | 46.7 | 6.0 |

Note that the yield strength of the middle location specimens where the localized induction heating was directed, namely Specimen Nos. 3, 4, 9 and 10, are considerably less than the yield strengths of the top and bottom location specimens. This illustrates the ability of induction heating to selectively and locally reduce the yield strength and increase the elongation of portions of a can body without adversely affecting the yield strength or elongation of other portions of the can body. It should also be noted that the percent elongation is, accordingly, increased in the heat treated areas.

The yield strength of specimens taken from the induction heated cans, as illustrated in Table 3, vary significantly from the bottom to the top of the short, about 2.75 inch tall, cans. Near the middle location, where the induction heating was directed, yield strength levels range from 18.7 to 28.4 ksi, and elongation varies from 18 to 24%. Just approximately one-half inch above or below this middle region yield strength levels are greater than 37 ksi and elongation values are 6% or less. Such relatively short wall containers exhibited extreme variations in sidewall properties, yet the central portion of such containers could be mechanically or electromagnetically bulged successfully into the configuration such as that shown in FIG. 3.

Figure 3:
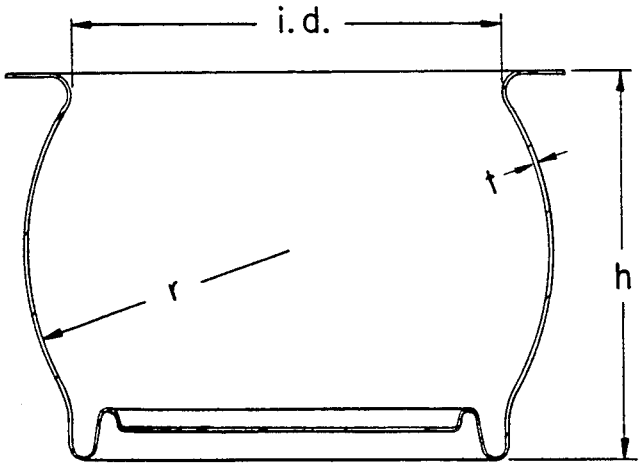
FIG. 3 is a cross sectional view of a bulged container body of the present invention.

FIG. 3 illustrates an exemplary container, namely a 5042-H19, 300×407 aluminum food can, induction heat treated and bulged with the following dimensions:

| | |
|---|---|
| radius (r) | 1.642 inch |
| inside diameter (i.d.) | 2.8774 inch |
| height (h) | 2.550 inch |
| thickness (t) | .009 inch |

The localized induction heating of the middle location specimens shown in Table 3 caused recrystallization of the metal into a very fine-grained microstructure. Note the photomicrographs of specimens from the top, middle and bottom of the container as shown, respectively, in FIGS. 4, 5 and 6. The fibrous cold-worked grain structure is retained in the top (FIG. 4) and bottom (FIG. 6) locations which are only one-half inch from the recrystallized, fine-grained specimen from the middle location (FIG. 5) which has been induction heat treated. The integrity of coatings typically utilized on drawn containers is maintained through the induction, partial anneal process because of the short duration of the heating period.

The circumferential portions of the sidewalls of containers heat treated by the process of the present invention may be bulged by a variety of techniques, including mechanical bulging and electromagnetic bulging. An exemplary method and apparatus for bulging containers is described in commonly assigned, U.S. Pat. No. 4,947,667 entitled Method and Apparatus for Reforming a Container, the contents of which are incorporated herein by reference.

In a preferred embodiment, multiple circumferential portions of the sidewall of an aluminum container body are treated and bulged. The selective thermal treatment of such portions reduces the yield strength of such portions by at least 20% with respect to the untreated portions of the container, including untreated sidewall regions and the untreated bottom end wall. In such preferred embodiment, a coil of electrically conductive material, such as wire, is disposed inside the container. The outside diameter of the coil is adjacent the inside surface of the container to a conductor-to-can distance of about 0.001 to 0.010 inch. The coil is energized to create an electromagnetic force. The force is sufficient to expand outwardly the thermally treated circumferential portions of the container. Yet, the untreated portions of the container retain strength to resist such force and not be permanently deformed into an outwardly bulged shape.

What is believed to be the best mode of the invention has been described above. It will be apparent to those skilled in the art that numerous variations of the illustrated details may be made without departing from the scope of this invention.

We claim:

1. A method of bulging at least a portion of a sidewall of a drawn aluminum container body having a bottom end wall, an open top, and generally cylindrical sidewalls, the sidewalls having a substantially uniform wall thickness and having a yield strength greater than about 30 ksi, comprising the steps of thermally treating a circumferential portion of the sidewall of the container that is to be bulged uniformly about the circumferential portion, at a temperature of at least 450° F. for a sufficient time to reduce the yield strength of the portion of the sidewall by at least 20% without substantially adversely affecting the yield strength of a top wall and a bottom circumferential portion of the container; and electromagnetically bulging at least a portion of the thermally treated sidewall of the container outwardly in a single operation at a circumferential strain of greater than about 5% by disposing a coil of electrically conductive material inside the container body and energizing the coil to create sufficient electromagnetic force to outwardly bulge the container without altering the diameter of the top circumferential portion of the container body.

2. A method as set forth in claim 1 wherein heat treating is accomplished by induction heating.

3. A method as set forth in claim 2 wherein at least one circumferential portion of the sidewall is heated inside an induction coil circumferentially surrounding each circumferential portion at a temperature of from 450° F. to 650° F. for a time of from 0.25 seconds to 10 seconds.

4. A method as set forth in claim 2 wherein at least one circumferential portion of the sidewall is heated, with an induction coil disposed inside the container body with each circumferential portion of the sidewall surrounding the induction coil, at a temperature of from 450° F. to 650° F. for a time of from 0.25 seconds to 10 seconds.

5. A method as set forth in claim 1 wherein the bulging is performed by electromagnetic force.

6. A method of uniformly heat treating at least one circumferential portion of a substantially uniform gauge sidewall of a drawn aluminum container body intermediate a top location and a bottom location, said circumferential sidewall portion having a yield strength greater than about 30 ksi adapted for subsequent outward bulging of the heat treated circumferential portions at a circumferential strain of from 3 to 13% in a single operation comprising induction heating each circumferential portion uniformly about the circumferential portion at a temperature of at least 450° F. for a sufficient time to lower the yield strength of the circumferential portion by at least 15% without substantially affecting the yield strength of the remaining portions of the container body by disposing a coil of electrically conductive material inside the container body and energizing the coil to create sufficient electromagnetic force to outwardly bulge the container without altering the diameter of the open top of the container body.

7. A method as set forth in claim 6 wherein heat treating is accomplished by induction heating.

8. A method as set forth in claim 7 wherein at least one circumferential portion of the sidewall is heated inside an induction coil circumferentially surrounding each circumferential portion at a temperature of from 450° F. to 650° F. for a time of from 0.25 seconds to 10 seconds.

9. A method as set forth in claim 7 wherein at least one circumferential portion of the sidewall is heated, with an induction coil disposed inside the container body with each circumferential portion of the sidewall surrounding the induction coil, at a temperature of from 450° F. to 650° F. for a time of from 0.25 seconds to 10 seconds.

10. A method as set forth in claim 6 wherein the bulging is performed by electromagnetic force.

11. A method of bulging at least a portion of a sidewall of a drawn aluminum container body having a bottom end wall, an open top, and generally cylindrical sidewalls, the sidewalls having a substantially uniform wall thickness and having a yield strength greater than about 30 ksi, comprising the steps of thermally treating multiple circumferential portions of the sidewall of the container to be bulged between top and bottom portions of the container body, to reduce the yield strength of the multiple treated portions of the sidewall by at least 20% with respect to untreated top, bottom and intermediate portions of the container; and electromagnetically bulging the thermally treated portions of the sidewall of the container outwardly by disposing a coil of electrically conductive material inside the container with an outside diameter of the coil adjacent the inside surface of the container, and energizing the coil to create an electromagnetic force sufficient to expand outwardly the thermally treated portions of the sidewall of the container.

12. A method for outwardly expanding the sidewall of a generally cylindrically shaped portion of an electrically responsive, metallic body, comprising the steps of:

retaining at least a first portion of the metallic body, disposing a coil of electrically conductive material inside the retained metallic body with the outer diameter of the coil adjacent inside surfaces of a portion of the sidewall to be expanded, energizing the coil to create an electromagnetic force sufficient to expand at least a portion of the sidewall of the metallic body adjacent the coil outwardly of the original generally cylindrical shape in an unrestricted area, and introducing a fluid between the coil and the inside surface of the metallic body during expansion of the sidewall to maintain at least positive gauge pressure throughout expansion of the sidewall, and treating at least one circumferential portion of the sidewall of the container between top and bottom portions thereof at a temperature of at least 450° F. for a sufficient time to lower the yield strength of the circumferential portion of the sidewall by at least about 15% without substantially affecting the yield strength of the remaining portions of the sidewall and the bottom end wall of the container, prior to the expansion of the sidewall.

* * * * *

UNITED STATES PATENT AND TRADEMARK OFFICE

CERTIFICATE OF CORRECTION

PATENT NO. : 5,058,408

DATED : October 22, 1991

INVENTOR(S) : Charles J. Leftault, Jr. et al

Figure 4:
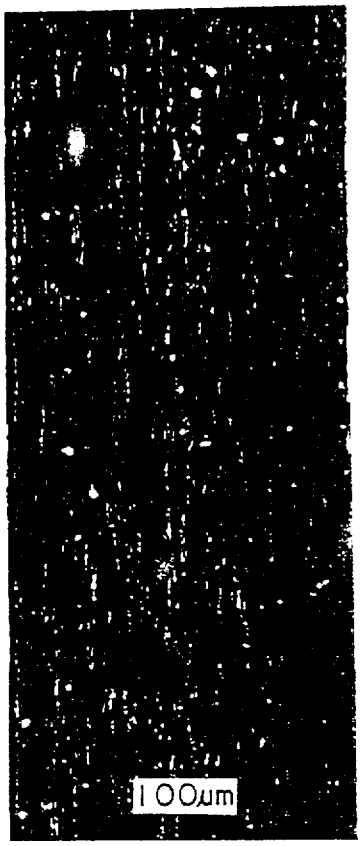
FIGS. 4, 5 and 6 are photomicrographs of specimens from the top, middle and bottom portions, respectively, of a localized induction heated container electropolished and viewed under polarized light at a magnification of 200X.
Figure 5:
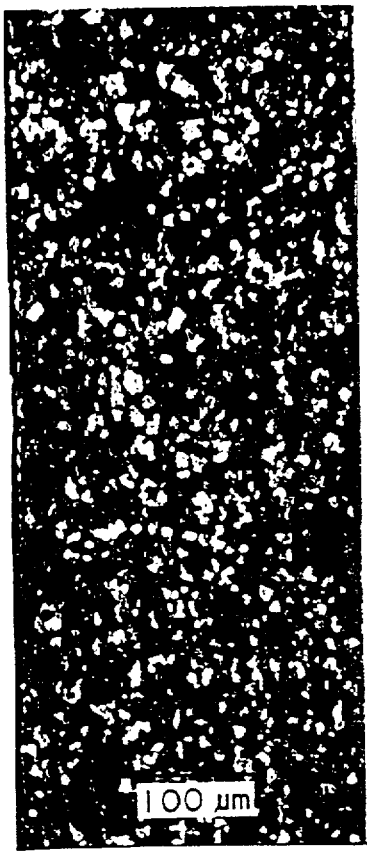
Figure 6:
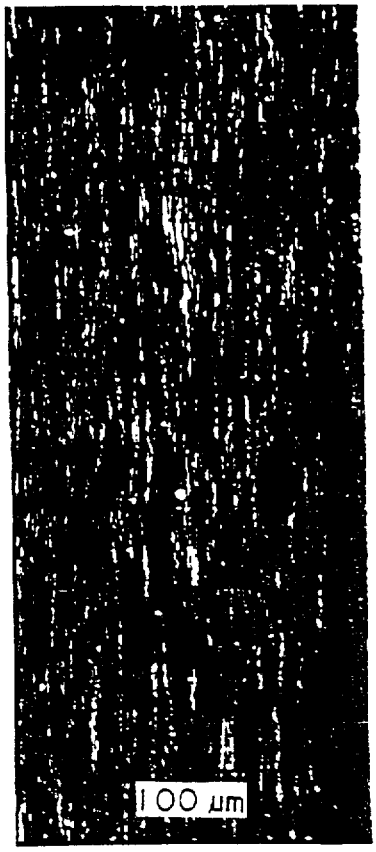

It is certified that error appears in the above-identified patent and that said Letters Patent is hereby corrected as shown below:

Insert Figures 4, 5 and 6 as part of Letters Patent as shown on the attached page.

Signed and Sealed this

Fifth Day of January, 1993

*Attest:*

DOUGLAS B. COMER

*Attesting Officer*

*Acting Commissioner of Patents and Trademarks*